US005135588A

United States Patent [19]

Okiyama et al.

[11] Patent Number: 5,135,588

[45] Date of Patent: Aug. 4, 1992

[54] SOFT-MAGNETIC NICKEL-IRON-CHROMIUM ALLOY FOR MAGNETIC CORES

[75] Inventors: Takuji Okiyama; Takuji Hara; Hisao Yasumura; Yutaka Kawai, all of Shinnanyo, Japan

[73] Assignee: Nisshin Steel Company Ltd., Tokyo, Japan

[21] Appl. No.: 667,808

[22] Filed: Mar. 12, 1991

[30] Foreign Application Priority Data

Mar. 27, 1990 [JP] Japan ..... 2-78215

[51] Int. Cl.[5] ..... C22C 19/05; C22C 38/14

[52] U.S. Cl. ..... 148/327; 148/333; 148/336; 148/427; 148/442; 420/97; 420/112; 420/121; 420/442; 420/452; 420/584.1

[58] Field of Search ..... 420/97, 112, 121, 442, 420/452, 580, 584.1; 148/327, 304, 333, 403, 336, 427, 442

[56] References Cited

U.S. PATENT DOCUMENTS 4,668,310 3/1987 Kudo et al. ..... 148/403

FOREIGN PATENT DOCUMENTS 0011828 1/1979 Japan .
142749 6/1987 Japan .
227065 10/1987 Japan .

*Primary Examiner*—R. Dean
*Assistant Examiner*—Sikyin Ip
*Attorney, Agent, or Firm*—Webb, Burden, Ziesenheim & Webb

[57] ABSTRACT

A Ni-Fe-Cr soft magnetic alloy essentially consisting of 40-50% Ni, 0.5-5% Cr and balance Fe and satisfying the following conditions:

$50 \leqq (Ni\%) + 4 \times (Cr\%) \leqq 60$;
$S + O + B \leqq 0.008\%$;
$S \leqq 0.003\%$;
$O \leqq 0.005\%$; and
$B \leqq 0.005\%$;

has excellent magnetic characteristics for magnetic core materials.

6 Claims, 2 Drawing Sheets

● MAXIMUM PERMEABILITY μm WHEN ALL THE FOLLOWING CONDITIONS ARE SATISFIED:

△ MAXIMUM PERMEABILITY μm WHEN ALL THE FOLLOWING CONDITIONS ARE NOT SATISFIED:

( S≦0.003%; O≦0.005%; B≦0.005%; AND S+O+B≦0.008%)

● MAXIMUM PERMEABILITY μm
WHEN ALL THE FOLLOWING CONDITIONS
ARE SATISFIED:
( S≦0.003%; O≦0.005%; B≦0.005%; AND S+O+B≦0.008%)

Δ MAXIMUM PERMEABILITY μm
WHEN ALL THE FOLLOWING CONDITIONS
ARE NOT SATISFIED:

SOFT-MAGNETIC NICKEL-IRON-CHROMIUM ALLOY FOR MAGNETIC CORES

FIELD OF THE INVENTION

This invention relates to a soft-magnetic Ni-Fe-Cr (nickel-iron-chromium) alloy suitable for magnetic core materials wherein high magnetic permeability and high saturated magnetic flux density are required.

BACKGROUND OF THE INVENTION

Ni-Fe alloys having high magnetic permeability are widely used as materials for magnetic cores such as cores of transformers for communication instruments, small motors, clocks, watches and the like. For such core materials, excellent magnetic permeability and high saturated magnetic flux density are required as direct current magnetic characteristics. For example, materials for clock cores and yokes should have a magnetic permeability ($\mu_m$) of not less than 35,000 and a saturated magnetic flux density ($B_{10}$) of not less than 11,000 G.

Conventionally, 45%-Ni Permalloy (trademark), which has the most excellent magnetic permeability and saturated magnetic flux density among the Ni-Fe magnetic alloys, is used as magnetic core materials to satisfy the above-mentioned requirements. Recently, however, it is desirable to make compact magnetic cores for various devices and the requirements for high performance magnetic cores are getting more and more severe. Under the circumstances, magnetic materials having improved magnetic permeability and saturated magnetic flux density are needed.

Japanese Laid-Open Patent Publication No. 142749/87 describes an attempt to improve the magnetic properties of magnetic materials by reducing O and S contents. Japanese Laid-Open Patent Publication No. 227065/87 describes another attempt wherein Mo is added and P and S contents are limited.

Alloys of 80%-Ni Permalloy series (JIS-PC corresponding to ASTM A753) exhibit the highest magnetic permeability and have the maximum magnetic permeability ($\mu_m$) of not less than 100,000, which is much higher than that achieved by alloys of JIS-PB series. However, the saturated magnetic flux density $B_{10}$ of the former is not satisfactory being at the level about 7000 G. Furthermore, JIS-PC alloys are expensive because they contain no less than about 80% of expensive Ni and the application thereof is limited due to this economical factor.

Accordingly, the object of the present invention is to provide an inexpensive soft magnetic alloy containing a reduced amount of Ni which is provided with the maximum magnetic flux density $B_{10}$ of not less than 11,000 and the maximum magnetic permeability ($\mu_m$) comparable to that of JIS-PC.

The inventors conducted extensive studies in search for a Ni-Fe soft magnetic alloy so as to achieve the above-mentioned object and found that a Ni-Fe-Cr soft magnetic alloy comprising 40–52% of Ni, 0.5–5% of Cr, not more than 0.003% of S, not more than 0.005% of O, not more than 0.005% of B and balance iron has a high saturated magnetic flux density $B_{10}$ and a high maximum magnetic permeability ($\mu_m$) of not less than 100,000.

SUMMARY OF THE INVENTION

The present invention provides a Ni-Fe-Cr soft magnetic alloy having excellent magnetic characteristics for magnetic core materials which essentially consists of:

Ni: 40–52%
Cr: 0.5–5%
$S \leqq 0.003\%$
$O \leqq 0.005\%$
$B \leqq 0.005\%$
and balance Fe
and satisfies the following conditions:
$50 \leqq (Ni\%) + 4 \times (Cr\%) \leqq 60$; and
$S + O + B \leqq 0.008\%$.

In the alloy of the present invention Si, Al (useful for deoxidizing agents) and Mn (useful for deoxidizing and desulfuring agents) may be contained up to 2% in total.

Cr: Cr is an element effective for improving the maximum magnetic permeability ($\mu_m$). This effect does not appear well with less than 0.5% Cr, while the saturated magnetic flux density $B_{10}$ decreases when the Cr content is excessive. Accordingly, the Cr content in the alloy of the present invention is limited to the range of 0.5–5%, preferably 1–4%, more preferably 1.5–3%.

Ni: Ni is an element effective for improving the saturated magnetic flux density $B_{10}$. It is observed that the saturated magnetic flux density $B_{10}$ tends to decrease when the Cr content is less than 40%. The effect of the addition of Ni in an amount of 0.5–5% improving magnetic properties is remarkable when the Ni content exceeds 40%. However, both the saturated magnetic flux density $B_{10}$ and the maximum magnetic permeability ($\mu_m$) show a tendency to decrease as the Ni content increases over 52%. Accordingly, the Ni content in the alloy of the present invention is limited to the range of 40–52%, preferably 42–51%, more preferably 44–50%.

Furthermore, addition of a large amount of Ni in the alloy raises the price of the alloy and is not advantageous. Accordingly, the Ni content in the alloy of the present invention is limited in the range of 40–52%.

The contents of Ni and Cr should satisfy the condition represented by the formula:

$$50 \leqq (Ni\%) + 4 \times (Cr\%) \leqq 60$$

so that the maximum magnetic permeability ($\mu_m$) may be comparable to or greater than that of JIS-PC alloys.

It is desirable to reduce the contents of impurity elements S, O and B as much as possible in order to improve magnetic properties. These impurity elements decrease the maximum magnetic permeability ($\mu_m$) hindering the growth of crystal grains and impairing the orientation of thereof. Therefore, the alloy composition should satisfy the following conditions: $S \leqq 0.003\%$, $O \leqq 0.005\%$, $B \leqq 0.005\%$ and $S + O + B \leqq 0.008\%$, preferably. $S \leqq 0.003\%$, $O \leqq 0.003\%$, $B \leqq 0.003\%$.

BRIEF DESCRIPTION OF THE ATTACHED DRAWINGS

DESCRIPTION OF THE INVENTION

Figure 1:
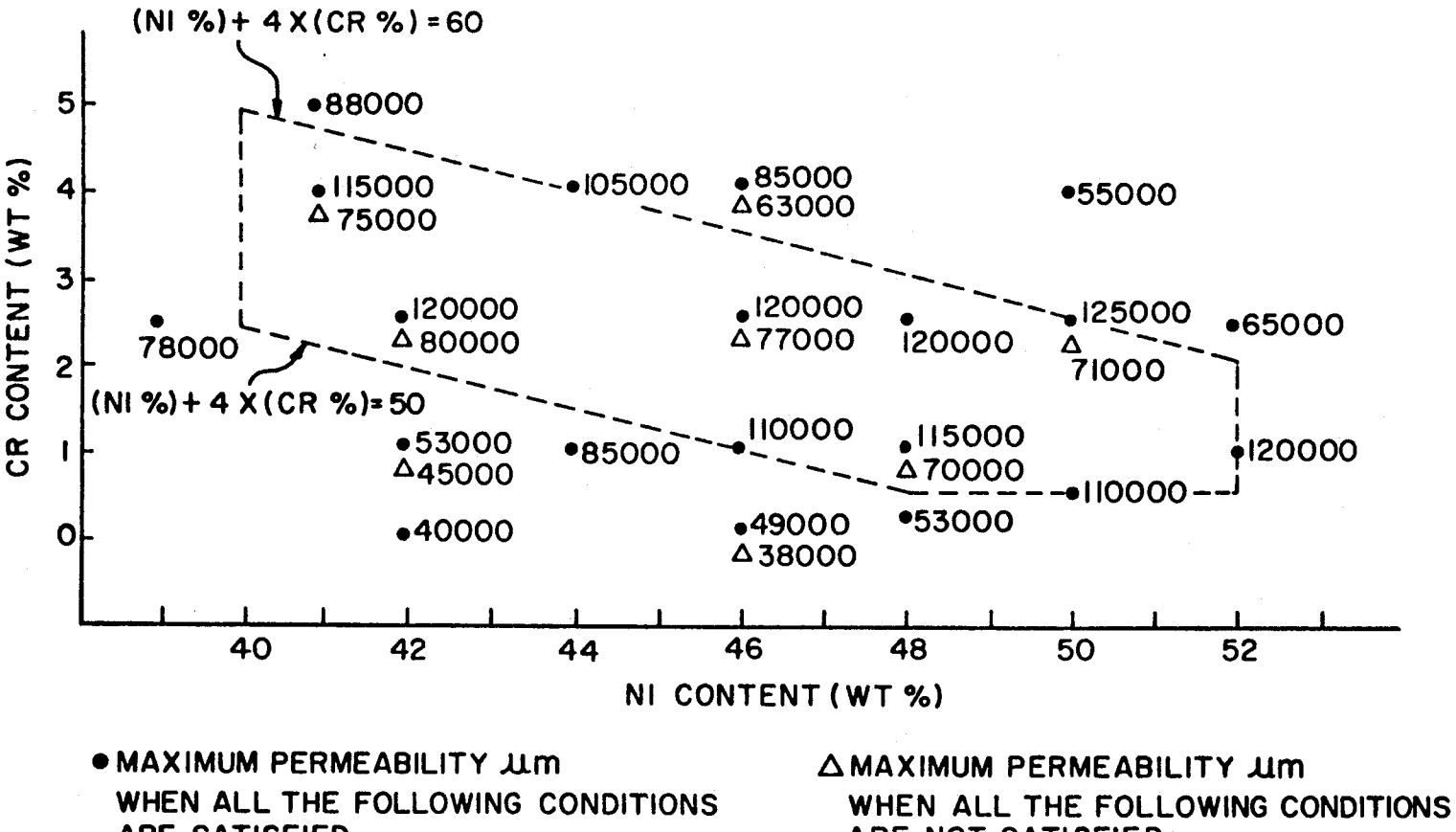
FIG. 1 is a diagram which shows the relation between the contents of Ni, Cr, S, O and B and the maximum magnetic permeability ($\mu_m$).

Features and effects of the present invention will be more clearly illustrated by way of the following examples.

Ingots of alloys of the compositions indicated in Table I were prepared by vacuum melting. Each of the ingots were hot-rolled and cold-rolled in an ordinary manner to form a 0.5 mm thick sheet.

Test pieces in the annular form having an diameter of 45 mm and an inner diameter of 33 mm were cut out from the cold-rolled sheets, subjected to magnetic annealing at 1100° C. for an hour in the hydrogen atmosphere and then cooled. The maximum magnetic permeability ($\mu_m$) and saturation magnetic flux density of the each test piece were measured following the test methods stipulated in JIS C2531. The results are also shown in Table I.

TABLE I

| Specimen No. | Composition and Magnetic Properties of Test Pieces: Composition (wt %) Ni | Cr | C | Si | Mn | Al | P | N | S | O | B | S + B + O | Magnetic Properties SFD[1] $B_{10}$ | MMP[2] μm | (Ni % + 4 Cr %) Value |
|---|---|---|---|---|---|---|---|---|---|---|---|---|---|---|---|
| 1 | 39.1 | 2.5 | 0.01 | 0.20 | 0.51 | 0.010 | 0.005 | 0.0022 | 0.0014 | 0.0021 | 0.0022 | 0.0057 | 12.400 G | 78.000 | 49.1 |
| 2* | 41.0 | 4.1 | 0.02 | 0.19 | 0.48 | 0.007 | 0.006 | 0.0020 | 0.0013 | 0.0022 | 0.0009 | 0.0044 | 12.000 G | 115.000 | 57.4 |
| 3 | 41.1 | 4.0 | 0.01 | 0.18 | 0.62 | 0.019 | 0.010 | 0.0024 | 0.0045 | 0.0020 | 0.0005 | 0.0070 | 11.900 G | 75.000 | 57.1 |
| 4 | 40.9 | 4.9 | 0.01 | 0.21 | 0.55 | 0.011 | 0.009 | 0.0019 | 0.0023 | 0.0037 | 0.0010 | 0.0070 | 11.000 G | 88.000 | 60.5 |
| 5 | 42.2 | tr. | 0.01 | 0.22 | 0.54 | 0.006 | 0.005 | 0.0020 | 0.0008 | 0.0024 | 0.0033 | 0.0065 | 14.300 G | 40.000 | 42.2 |
| 6 | 42.1 | 1.0 | 0.01 | 0.15 | 0.44 | 0.005 | 0.004 | 0.0016 | 0.0020 | 0.0021 | 0.0025 | 0.0066 | 13.500 G | 53.000 | 46.1 |
| 7 | 42.0 | 1.0 | 0.02 | 0.18 | 0.49 | 0.014 | 0.005 | 0.0021 | 0.0025 | 0.0028 | 0.0045 | 0.0098 | 13.600 G | 45.000 | 46.0 |
| 8* | 41.9 | 2.4 | 0.01 | 0.19 | 0.50 | 0.011 | 0.006 | 0.0017 | 0.0017 | 0.0022 | 0.0010 | 0.0049 | 12.300 G | 120.000 | 51.5 |
| 9 | 42.0 | 2.5 | 0.02 | 0.20 | 0.51 | 0.007 | 0.011 | 0.0022 | 0.0013 | 0.0055 | 0.0007 | 0.0075 | 12.200 G | 80.000 | 52.0 |
| 10 | 44.0 | 1.1 | 0.02 | 0.20 | 0.52 | 0.006 | 0.005 | 0.0023 | 0.0020 | 0.0017 | 0.0020 | 0.0057 | 13.700 G | 85.000 | 48.4 |
| 11* | 43.9 | 3.8 | 0.01 | 0.16 | 0.44 | 0.008 | 0.010 | 0.0020 | 0.0011 | 0.0018 | 0.0015 | 0.0044 | 12.000 G | 105.000 | 59.1 |
| 12 | 46.0 | tr. | 0.01 | 0.21 | 0.47 | 0.014 | 0.006 | 0.0022 | 0.0015 | 0.0020 | 0.0020 | 0.0055 | 15.000 G | 49.000 | 46.0 |
| 13 | 46.0 | 0.1 | 0.01 | 0.25 | 0.47 | 0.015 | 0.005 | 0.0019 | 0.0009 | 0.0043 | 0.0058 | 0.0110 | 15.000 G | 38.000 | 46.4 |
| 14* | 46.1 | 1.0 | 0.01 | 0.20 | 0.52 | 0.021 | 0.007 | 0.0018 | 0.0008 | 0.0021 | 0.0007 | 0.0036 | 14.200 G | 110.000 | 50.1 |
| 15* | 46.0 | 2.5 | 0.02 | 0.21 | 0.61 | 0.010 | 0.009 | 0.0021 | 0.0024 | 0.0027 | 0.0011 | 0.0062 | 13.000 G | 120.000 | 56.0 |
| 16 | 46.2 | 2.6 | 0.02 | 0.19 | 0.58 | 0.009 | 0.008 | 0.0019 | 0.0010 | 0.0014 | 0.0054 | 0.0078 | 12.900 G | 77.000 | 56.6 |
| 17 | 46.2 | 4.0 | 0.02 | 0.18 | 0.49 | 0.018 | 0.007 | 0.0020 | 0.0015 | 0.0015 | 0.0046 | 0.0076 | 11.600 G | 85.000 | 62.2 |
| 18 | 46.0 | 3.9 | 0.01 | 0.15 | 0.49 | 0.023 | 0.006 | 0.0016 | 0.0022 | 0.0038 | 0.0030 | 0.0090 | 11.500 G | 63.000 | 61.6 |
| 19 | 48.0 | 0.3 | 0.02 | 0.21 | 0.44 | 0.022 | 0.005 | 0.0017 | 0.0020 | 0.0021 | 0.0008 | 0.0049 | 14.800 G | 53.000 | 49.2 |
| 20* | 47.9 | 1.1 | 0.01 | 0.21 | 0.47 | 0.005 | 0.005 | 0.0021 | 0.0014 | 0.0011 | 0.0006 | 0.0031 | 14.300 G | 115.000 | 52.3 |
| 21 | 47.9 | 1.0 | 0.01 | 0.22 | 0.46 | 0.013 | 0.004 | 0.0021 | 0.0037 | 0.0018 | 0.0009 | 0.0064 | 14.200 G | 70.000 | 51.9 |
| 22* | 48.0 | 2.5 | 0.02 | 0.21 | 0.51 | 0.014 | 0.011 | 0.0015 | 0.0012 | 0.0019 | 0.0020 | 0.0051 | 13.000 G | 120.000 | 58.0 |
| 23* | 50.1 | 0.6 | 0.01 | 0.19 | 0.53 | 0.005 | 0.009 | 0.0017 | 0.0016 | 0.0011 | 0.0030 | 0.0057 | 14.300 G | 110.000 | 51.7 |
| 24* | 50.2 | 2.4 | 0.01 | 0.20 | 0.52 | 0.023 | 0.008 | 0.0021 | 0.0015 | 0.0020 | 0.0005 | 0.0040 | 13.100 G | 125.000 | 59.8 |
| 25 | 50.0 | 2.5 | 0.01 | 0.20 | 0.54 | 0.018 | 0.006 | 0.0018 | 0.0014 | 0.0060 | 0.0005 | 0.0079 | 13.200 G | 71.000 | 60.0 |
| 26 | 50.1 | 4.0 | 0.01 | 0.18 | 0.50 | 0.010 | 0.010 | 0.0024 | 0.0018 | 0.0019 | 0.0020 | 0.0047 | 11.900 G | 55.000 | 66.1 |
| 27* | 51.9 | 1.1 | 0.02 | 0.19 | 0.49 | 0.006 | 0.005 | 0.0023 | 0.0022 | 0.0021 | 0.0009 | 0.0052 | 14.000 G | 120.000 | 56.3 |
| 28 | 52.0 | 2.4 | 0.01 | 0.20 | 0.50 | 0.007 | 0.006 | 0.0020 | 0.0024 | 0.0011 | 0.0032 | 0.0067 | 13.100 G | 65.000 | 61.6 |

[1]SFD: Saturated Flux Density
[2]MMP: Maximum Magnetic Permeability
*Alloys of the present invention (Specimen No. 12 is a 46%-Ni Permalloy)

The relation of the maximum permeability ($\mu_m$) to the Ni content was studied for all the test pieces. The results are shown in FIG. 1. As can be seen from FIG. 1, the maximum permeability ($\mu_m$) is improved by Cr when the Ni content is in the range of 40–52%. It was also confirmed that the alloys having compositions within the area surrounded by broken line in FIG. 1 has the maximum permeability ($\mu_m$) comparable to or better than that of JIS-PC alloys when the contents of S, O and B are limited so that they satisfy the condition: $S+O+B \leqq 0.008\%$.

No significant effect of the reduction of impurities S, O and B on the magnetic flux density (B10) was observed. The magnetic flux density (B10) is not less than 11,000 G when the Ni content is 40–52% and the Cr content is not more than 5%.

Figure 2:
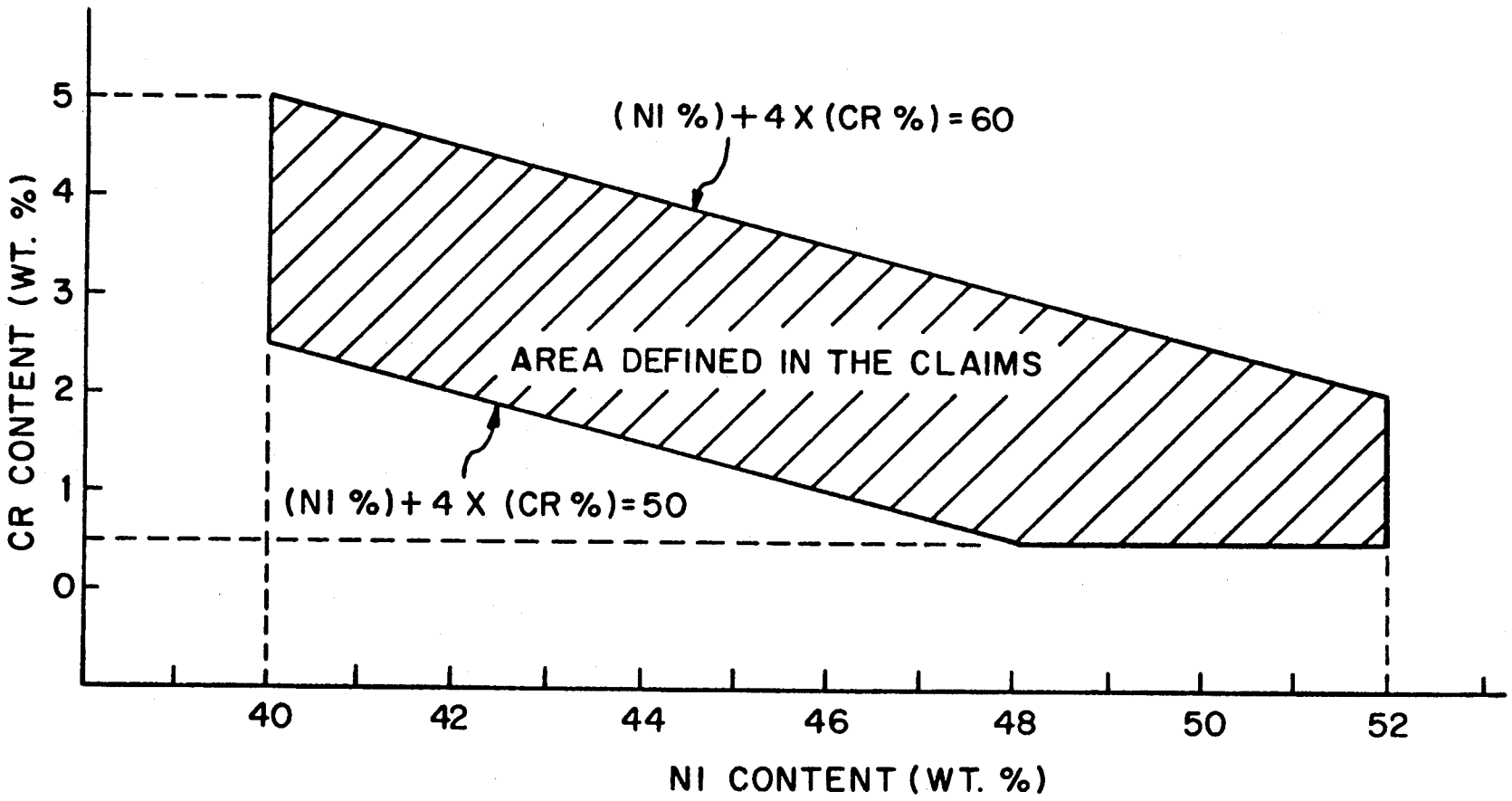
FIG. 2 is a diagram which shows the area of the composition defined in the claims.

FIG. 2 shows the area wherein the Ni and Cr contents satisfy the conditions of the present invention. An improved Ni-Fe-Cr alloy having a saturated magnetic flux density $B_{10}$ not less than 11,000 G and a maximum magnetic permeability ($\mu_m$) not less than 100,000 which are required for core materials can be obtained when the Ni and Cr contents are selected in the hatched area in FIG. 2 and the impurities are reduced so that $S+O+B$ may be not more than 0.008%.

As described above, Ni-Fe-Cr soft magnetic alloys having magnetic properties required for magnetic cores were provided according to the present invention by defining the Cr and Ni contents in a specific relation and limiting impurities including S, O and B. Furthermore, the Ni-Fe-Cr soft magnetic alloys of the present invention do not contain such expensive metals as Ni and Mo in a large amount and accordingly can be prepared in a low cost.

We claim:

1. A Ni-Fe-Cr soft magnetic alloy having excellent magnetic characteristics for magnetic core materials and exhibiting a μm value ≧100,000 and a $B_{10}$ value ≧11,000 which essentially consists of:

Ni: 40–52%
Cr: 0.5–5%
$S \leqq 0.003\%$
$O \leqq 0.005\%$
$B \leqq 0.005\%$
and balance Fe and satisfies the following conditions:

$50 \leqq (Ni\%)+4\times(Cr\%) \leqq 60$; and
$S+O+B \leqq 0.008\%$.

2. A Ni-Fe-Cr soft magnetic alloy as claimed in claim 1, wherein O content is not more than 0.003% and B content is not more than 0.003%.

3. A Ni-Fe-Cr soft magnetic alloy as claimed in claim 1, wherein Ni content is 42–51% and Cr is 1–4%.

4. A Ni-Fe-Cr soft magnetic alloy as claimed in claim 2, wherein Ni content is 42–51% and Cr is 1–4%.

5. A Ni-Fe-Cr soft magnetic alloy as claimed in claim 1, wherein Ni content is 44–50% and Cr is 1.5–3%.

6. A Ni-Fe-Cr soft magnetic alloy as claimed in claim 2, wherein Ni content is 44–50% and Cr is 1.5–3%.

* * * * *

UNITED STATES PATENT AND TRADEMARK OFFICE

CERTIFICATE OF CORRECTION

PATENT NO. : 5,135,588

DATED : August 4, 1992

INVENTOR(S) : Takuji Okiyama, Takuji Hara, Hisao Yasumura and Yutaka Kawai

It is certified that error appears in the above-identified patent and that said Letters Patent is hereby corrected as shown below:

Title Page:

Abstract Line 2 "50%" should read --52%--.

Column 2 Lines 54-55 "preferably." should read --preferably,--.

Column 3 Line 5 "an" should read --a--.

Column 3 Line 10-11 before "each" delete --the--.

Column 3 Line 58 "(B10)" should read --($B_{10}$)--.

Column 3 Line 59 "(B10)" should read --($B_{10}$)--.

Between columns 3 and 4, lines 13-39:

Table 1, the two columns under the subtitle "Magnetic Properties", all of the "periods (.)" should be --commas (,)--.

Signed and Sealed this

Twenty-eighth Day of September, 1993

*Attest:*

*Attesting Officer*

BRUCE LEHMAN

*Commissioner of Patents and Trademarks*